US009863281B2

(12) United States Patent
Polvi

(10) Patent No.: US 9,863,281 B2
(45) Date of Patent: Jan. 9, 2018

(54) CARBON DIOXIDE CAPTURE INTERFACE FOR POWER GENERATION FACILITIES

(71) Applicant: Esko Olavi Polvi, Bonita Springs, FL (US)

(72) Inventor: Esko Olavi Polvi, Bonita Springs, FL (US)

( * ) Notice: Subject to any disclaimer, the term of this patent is extended or adjusted under 35 U.S.C. 154(b) by 259 days.

(21) Appl. No.: 14/962,559

(22) Filed: Dec. 8, 2015

(65) Prior Publication Data

US 2017/0159502 A1 Jun. 8, 2017

(51) Int. Cl.

| | |
|---|---|
| ***F01K 7/16*** | (2006.01) |
| ***F23J 15/04*** | (2006.01) |
| ***F22D 1/02*** | (2006.01) |
| ***F23J 15/00*** | (2006.01) |

(52) U.S. Cl.

CPC ..... *F01K 7/16* (2013.01); *F22D 1/02* (2013.01); *F23J 15/006* (2013.01); *F23J 15/04* (2013.01); *F23J 2215/10* (2013.01); *F23J 2215/20* (2013.01); *F23J 2215/50* (2013.01); *F23J 2217/10* (2013.01); *F23J 2219/10* (2013.01); *F23J 2219/40* (2013.01)

(58) Field of Classification Search

CPC ..... F01K 7/16; F23J 15/04; F22D 1/02
USPC ..... 60/670
See application file for complete search history.

(56) References Cited

U.S. PATENT DOCUMENTS

| | | | |
|---|---|---|---|
| 4,425,757 | A | 1/1984 | Heyn et al. |
| 4,542,621 | A | 9/1985 | Andersson et al. |
| 6,655,150 | B1 | 12/2003 | Asen et al. |
| 8,752,382 | B2 | 6/2014 | Polvi |
| 2007/0227118 | A1 | 10/2007 | Hu et al. |
| 2008/0104958 | A1 | 5/2008 | Finkenrath et al. |
| 2011/0113779 | A1* | 5/2011 | Polvi ..... F01K 23/062 60/646 |
| 2011/0149300 | A1 | 6/2011 | Tekeda |
| 2011/0314815 | A1 | 12/2011 | Li et al. |

FOREIGN PATENT DOCUMENTS

| | | |
|---|---|---|
| EP | 2261631 | 12/2010 |
| WO | 2009025003 | 2/2009 |
| WO | 2009122947 | 10/2009 |

* cited by examiner

*Primary Examiner* — Jason Shanske
(74) *Attorney, Agent, or Firm* — Cohen & Grigsby, PC

(57) ABSTRACT

In a power generation facility (10) wherein a fluidized bed combustion unit (12) produces steam to power a steam turbine generator (32), a heat recovery steam generator (20) produces steam for the steam turbine generator. Electrical power from the steam turbine generator is conducted to a motor (40) that drives and air compressor (36). The air compressor provides pressurized air back to the fluidized bed combustion unit (12) to promote fuel combustion. Flue gas from the heat recovery steam generator is selectively conducted to a CO2 capture unit (18) and then to a gas expander (42) that assists the motor in driving the air compressor (36). A heat exchanger (46) that is upstream of the CO2 Capture Unit and a heat exchanger (56) that is downstream of the CO2 Capture Unit and upstream of the air expander have thermal fluid sides that are connected in a closed circuit. The heat exchangers (46 and 56) convey heat away from the CO2 Capture Unit and provide heat to flue gas flowing to the gas expander to avoid icing conditions in the gas expander and acid condensation in the air emission stack.

16 Claims, 2 Drawing Sheets

CARBON DIOXIDE CAPTURE INTERFACE FOR POWER GENERATION FACILITIES

BACKGROUND OF THE INVENTION

Field of the Invention

The presently disclosed invention relates to fossil fuel power generation facilities and, more particularly, systems for adapting such facilities for removal and capture of carbon dioxide from combustion exhaust gases.

Discussion of the Prior Art

Various commercial systems and process for combusting fossil fuels to generate electrical power have been in use for many years. One difficulty with the use of such systems has been that they emit quantities of carbon dioxide—a greenhouse gas. It is believed that greenhouse gases such as carbon dioxide cause a deleterious effect when released into the atmosphere in quantity. Accordingly, fossil fuel power plants have emphasized systems and methods having lower emissions of greenhouse gases.

One system for more efficient combustion of fossil fuel and consequently lower carbon dioxide emissions employs technology known as pressurized fluidized bed combustion. In that system, fuel such as coal is introduced into a pressurized vessel and combusted while a stream of air is forced through the fuel. This has been found to result in more complete combustion of the coal and lower emissions of carbon dioxide in comparison to some other systems and processes.

It has been observed that a process for removing and capturing carbon dioxide from the exhaust emissions of the pressurized fluidized bed combustion could further reduce carbon dioxide emissions, provided the process was compatible with the fluidized bed combustion technology. One process for removing and capturing carbon dioxide from a gas stream is known as the Benfield process. In the Benfield process, carbon dioxide and other gaseous components are absorbed in a pressurized aqueous solution of potassium carbonate. The Benfield process has been found to be effective when used in connection with pressurized fluidized bed systems, provided the operating conditions for the Benfield process are met. In particular, the maximum operating temperature, the concentrations of sulfur dioxide and nitrous oxides must be satisfied. Because the temperature, sulfur dioxide and nitrous oxide in exhaust gases from the pressurized fluidized bed combustion process are high relative to those requirements. Accordingly, an interface between the pressurized fluidized bed combustion process and the Benfield process is required.

One interface for using the Benfield process in combination with a pressurized fluidized bed combustion process is shown and described in U.S. Pat. No. 8,752,384. In that system, exhaust gas from the pressurized fluidized bed combustion vessel is provided to a heat recovery steam generator. The heat recovery steam generator uses a portion of the thermal energy from the exhaust gas to convert feed water to steam. The steam is then used to power a steam turbine generator and electricity from the steam turbine generator is used to power an electric motor that drives an air compressor. The air compressor pressurizes air that is fed to the pressurized fluidized bed combustion vessel.

Exhaust gas that leaves the heat recovery steam generator is conditioned by the removal of particulates and sulfur dioxide and then provided to the Benfield processing unit for removal and capture of carbon dioxide. During startup periods, the conditioned exhaust gas (also known as flue gas) does not meet the temperature requirements for the Benfield process so the flue gas is diverted to bypass the Benfield processing unit.

To make the system more efficient, the air compressor that pressurizes air to the pressurized fluidized bed combustion vessel is powered by a second device—a gas expander. The gas expander coverts energy in the flue gas to mechanical power in a shaft that is coupled to the air compressor.

A difficulty with such systems is that the expansion of the flue gas in the gas expander causes a drop in the temperature of the flue gas. In some cases, this can cause icing in the gas expander or can cause the flue gas to form acidic condensation in the air emission stack. This difficulty cannot be avoided by maintaining a generally higher temperature for the flue gas because such higher flue gas temperatures are incompatible with the Benfield process for removing carbon dioxide.

Accordingly, there was a need in the prior art for a power generation system wherein a pressurized fluidized bed combustion unit that employs Benfield technology to remove of carbon dioxide from exhaust gases also maintains sufficiently high temperatures in the flue gas to avoid difficulties associated with low temperature conditions in the gas expander and in the air discharge stack.

SUMMARY OF THE INVENTION

In accordance with the presently disclosed invention, a power generation facility may include a pressurized fluidized bed combustion unit with interface that makes the facility compatible with a unit for removing carbon dioxide from combustion gases. The interface may include a heat recovery steam generator that generates steam in response to feed water in combination with exhaust gasses from the pressurized fluidized bed combustion unit. A steam turbine generator can generate electrical power in response to steam that is supplied from the heat recovery steam generator. An air compressor that supplies pressurized air to the pressurized fluidized bed combustion unit can have a first drive such as a variable speed electrical motor that is electrically connected to the steam turbine generator and that is mechanically coupled to the air compressor. During transient start-up conditions, electrical power to the variable speed motor that drives the air compressor for pressurized air to the fluidized bed combustion unit can be provided from utility electric power or other source that is external to the power generation cycle disclosed herein. The air compressor also can have a second drive that may be a gas expander that receives flue gas and that is mechanically coupled to the air compressor. In an embodiment, a first heat exchanger receives flue gas from the heat recovery steam generator and a second heat exchanger discharges flue gas to the gas expander. Equipment for removing and capturing carbon dioxide can be included in the pathway of flue gas that flows from the first gas expander to the second gas expander. The first heat exchanger and the second heat exchanger also may each have respective input ports and output ports with the input port of the first heat exchanger connected to the output port of the second heat exchanger and the output port of the first heat exchanger connected to the output port of the second heat exchanger such that a closed flow path is constructed through the input ports and output ports of the first and second heat exchangers. The circulation of thermal fluid through the closed flow path may convey heat from flue gas passing through the first heat exchanger to flue gas passing through the second heat exchanger to convey heat from the first heat exchanger to the second heat exchanger. This can cause the temperature of flue gas flowing from the second heat exchanger to be higher than the temperature of flue gas flowing from the first heat exchanger. The temperature of the flue gas flowing from the second heat exchanger to the gas expander is high enough to avoid icing conditions in the gas expander and also to avoid the formation of acidic condensate in the air emission stack.

Preferably, flu gas that flows from said first heat exchanger to said second heat exchanger is conditioned before reaching the carbon dioxide treatment unit. Such conditioning may include the removal of particulate matter, the removal of sulfur dioxide, and the removal of nitrous oxides. Removal of the particulates, sulfur dioxide and nitrous oxides in this way may improve operating conditions for the carbon dioxide removal and capture unit. Removal of particulates at the lower flue gas temperatures of the flue gas between the first and second heat exchangers also allows the use of metal matrix filters that are lower cost than filters that are designed for use at higher temperatures.

Also preferably, the presently disclosed invention may include an embodiment with an interface for use in a power generation facility that includes a pressurized fluidized bed combustion unit and wherein the facility is adapted for a unit that removes carbon dioxide from exhaust gases from the pressurized fluidized bed combustion unit. The interface may include a heat recovery steam generator that generates steam at a steam output port and flue gases at an exhaust gas output port when feed water is provided to a water intake port in combination with exhaust gases from the pressurized fluidized bed combustion unit provided. A steam turbine generator is connected to the steam output port of the heat recovery steam generator so that the steam turbine generator produces electrical power. An air compressor that is connected to the air feed of the pressurized fluidized bed combustion unit has an electrical motor that is electrically connected to the steam turbine generator and that is mechanically coupled to the air compressor. The air compressor can also have a second drive that is a gas expander that may be responsive to flue gases and that may be selectively mechanically coupled to the air compressor. A heat exchanger that is in communication with a gas input port of the gas expander can have a thermal fluid input port that is in communication with the steam output port of the heat recovery steam generator causing the heat exchanger to increase the temperature of flue gas flowing into the gas expander.

Also preferably, in the disclosed interface a flue gas output of said heat recovery steam generator is in communication with the upstream side of the unit for removing carbon dioxide for exhaust gas and the flue gas input port of the heat exchanger is in communication with the downstream side of the unit for removing carbon dioxide from exhaust gas. The heat recovery steam generator can be established so that the temperature of flue gas from the heat recovery steam generator is compatible with operating temperature for flue gas as required by the unit for removing carbon dioxide from flue gas.

Other embodiments, features and advantages of the presently disclosed invention will become apparent to those skilled in the art as the following description of several presently preferred embodiments thereof proceeds.

BRIEF DESCRIPTION OF THE DRAWINGS

The accompanying drawings show several presently preferred embodiments of the presently disclosed invention wherein.

DESCRIPTION OF PRESENTLY PREFERRED EMBODIMENTS

Figure 1:
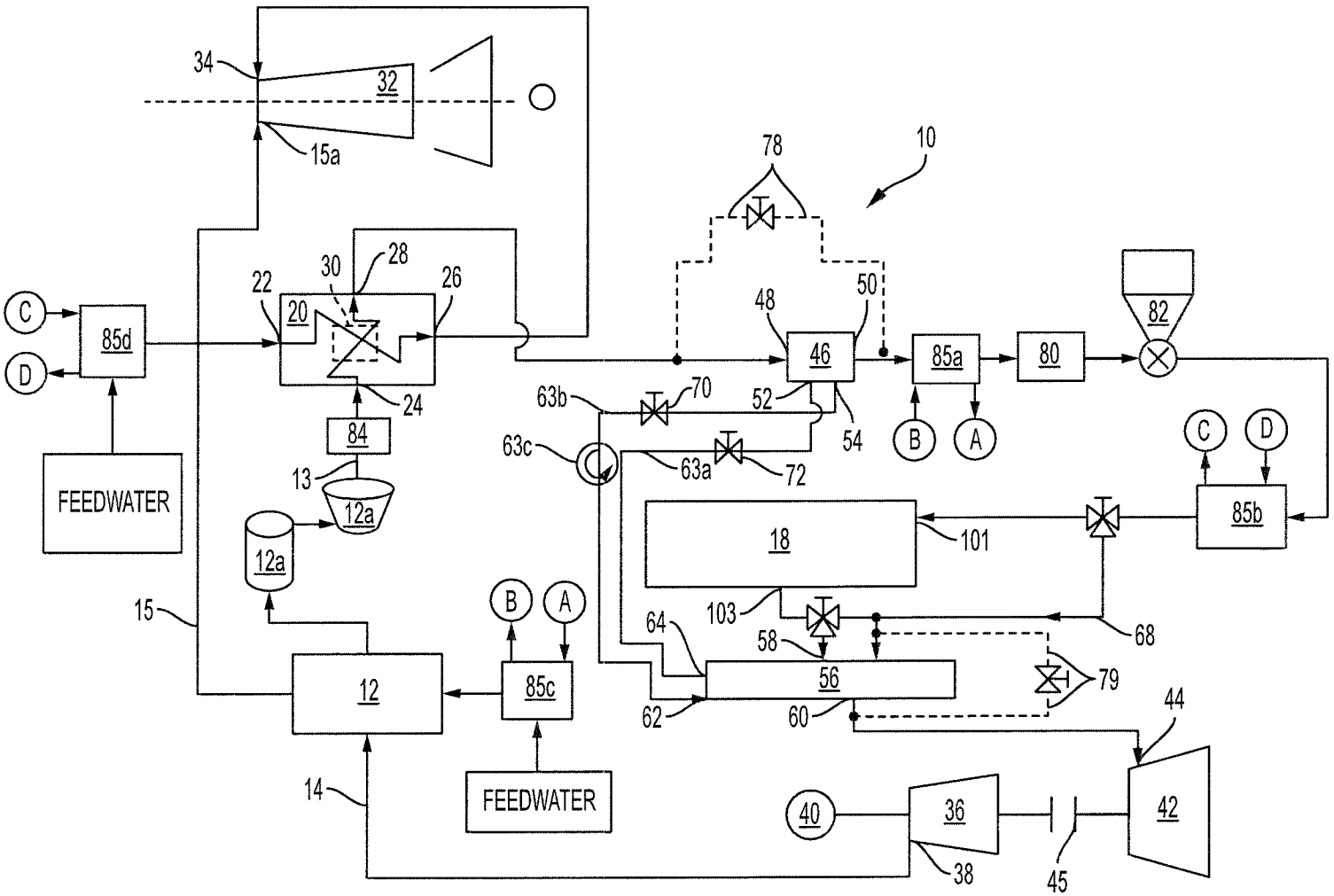
FIG. 1 is a schematic diagram of a power generation facility that includes an improved interface for a unit for removing carbon dioxide. The interface has closed loop circulation of thermal fluid between first and second heat exchangers to convey heat from a location upstream of the carbon dioxide removal unit to a location downstream of the carbon dioxide removal unit.

A schematic diagram of the presently preferred embodiment of the disclosed invention is shown in FIG. 1 wherein a facility 10 for the generation of electrical power includes a pressurized fluidized bed combustion unit 12 (herein "PFBCU 12"). PFBCU 12 includes a pressurized air vessel and a steam boiler that is heated by combustion of a carbon fuel bed such as a coal bed. Exhaust gas from the combustion vessel can be treated for particulate removal by one or more cyclone separators 12*a* and then discharged through a conduit 13. To promote more complete combustion of the coal bed in PFBCU 12, pressurized air is supplied to PFBCU 12 through an air feed 14. Steam from the boiler in PFBCU 12 is provided through line 15 to a steam turbine generator 32 to generate electrical power. In alternative embodiments, the steam from the PFBCU boiler can be used for purposes of direct heating or as an energy source.

FIG. 1 illustrates an interface for adapting the power generation facility 10 so that it is compatible with a unit 18 for removing and capturing carbon dioxide (herein "CO2 Capture Unit 18") from gases that are exhausted from discharge conduit 13 of PFBCU 12. The interface includes a heat recovery steam generator 20 (herein "HRSG 20") that has a water intake port 22 for receiving feed water and an exhaust gas input port 24 that receives exhaust gases from discharge conduit 13 of PFBCU 12. HRSG 20 also includes a steam output port 26 that is in communication with the water intake port 22, an exhaust gas output port 28 that is in communication with the exhaust gas input port 24, and a heat transfer member 30. Heat transfer member 30 is located internally in HRSG 20 between the pathway between exhaust gas input port 24 and exhaust gas output port 28 and the pathway between water intake port 22 and steam output port 26. The heat transfer member 30 physically isolates exhaust gas that flows through HRSG 20 from the exhaust gas input port 24 to the exhaust gas output port 28 from water and steam that flows from the water intake port 22 to steam output port 26. At the same time, heat transfer member 30 conducts heat from the exhaust gases that flow between exhaust gas input port 24 and exhaust gas output port 28 to water that is flowing from the water intake port 22 to steam output port 26. When water in HRSG 20 has absorbed sufficient heat at the vapor pressure in the pathway between water intake port 22 and steam output port 26, the water coverts to steam that is produced at steam output port 26 of HRSG 20. In this way, HRSG 20 receives exhaust gases from PFBCU 12 and feed water at water intake port 22 and provides exhaust gasses at exhaust gas output port 28 and steam at steam output port 26. In an embodiment, the temperature of exhaust gases at exhaust gas output port 28 can be 650-350° F. at pressure of 145-255 psi.

The interface further involves steam turbine generator 32 that has a steam input port 34 that is in communication with the steam output port 26 of HRSG 20. Steam turbine generator 32 produces electrical power in response to the flow of steam from steam output port 26 of HRSG 20 to steam input port 34 in combination with stem to turbine generator 32 from PFBCU 12.

An air compressor 36 has an output port 38 that is connected to the air feed 14 of PFBCU 12. Air compressor 36 provides air flow to PFBCU 12 at a suitable pressure to fluidize the fuel bed and improve combustion efficiency of the fuel. Air compressor 36 has a first drive that is a variable frequency electric motor 40. Variable frequency electric motor 40 is electrically connected to the electrical power output of steam turbine generator 32. The shaft of variable frequency motor 40 is mechanically coupled to the shaft of air compressor 36 so that variable frequency electric motor 40 drives air compressor 36 in response to electric power from steam turbine generator 32.

Air compressor 36 also has a second drive that is a gas expander 42 that include a gas input port 44. Gas expander 42 is responsive to the flow of pressurized gases into gas input port 44. A clutch 45 is connected between gas expander 42 and the shaft of air compressor 36. Clutch 45 adds additional torque to the air compressor shaft and drives the air compressor to full load by selectively mechanically coupling gas expander 42 to air compressor 36 through clutch 45.

The interface of FIG. 1 further includes two heat exchangers that are connected together in a closed loop relationship. More specifically, a thermal extraction heat exchanger 46 includes a flue gas input port 48 and a flue gas output port 50 that is in communication with the flue gas input port 48 through a pathway that is internal to thermal extraction heat exchanger 46. Thermal extraction heat exchanger 46 also includes a thermal fluid input port 52 and a thermal fluid output port 54 that is in communication with thermal fluid input port 52 through a pathway that is internal to thermal extractor heat exchanger 46. The pathway through thermal extraction heat exchanger 46 between flue gas input port 48 and flue gas output port 50 is isolated from the pathway through thermal extraction heat exchanger 46 between thermal fluid input port 52 and thermal fluid output port 54. The internal structure of thermal extraction heat exchanger 46 that separates the two pathways is conductive of heat such that heat from flue gas that flows through the first pathway is transferred to thermal fluid that flows through the second pathway. The result is that the temperature of flue gas at flue gas output port 50 is lower than the temperature of flue gas at input port 48 and the temperature of thermal fluid at thermal fluid output port 54 is higher than the temperature of thermal fluid at thermal fluid input port 52. For example, in an embodiment, flue gas 48 can be 900-650° F. at 145-255 psi.

A second heat exchanger is connected to the thermal extraction heat exchanger 46 in closed loop relationship. More specifically, a thermal addition heat exchanger 56 includes a flue gas input port 58 and a flue gas output port 60 that is in communication with the flue gas input port 58 through a pathway that is internal to thermal addition heat exchanger 56. Thermal addition heat exchanger 56 also includes a thermal fluid input port 62 and a thermal fluid output port 64 that is in communication with thermal fluid input port 62 through a pathway that is internal to thermal addition heat exchanger 56. The pathway through thermal addition heat exchanger 56 between flue gas input port 58 and flue gas output port 60 is isolated from the pathway through thermal extraction heat exchanger 56 between thermal fluid input port 62 and thermal fluid output port 64. The internal structure of thermal addition heat exchanger 56 that separates the two pathways is conductive of heat such that heat from thermal fluid that flows through the second pathway is transferred to flue gas that flows through the first pathway. The result is that the temperature of flue gas at flue gas output port 60 is higher than the temperature of flue gas at flue gas input port 58 and the temperature of thermal fluid at thermal fluid output port 64 is lower than the temperature of thermal fluid at thermal fluid input port 62.

In terms of flow direction of flue gas, thermal extraction heat exchanger 46 is located downstream of HRSG 20 with flue gas input port 48 of thermal extraction heat exchanger 46 in communication with the exhaust gas output port 28 of HRSG 20. Also, thermal addition heat exchanger 56 is located downstream of thermal extraction heat exchanger 46 with flue gas output port 50 of thermal extraction heat exchanger 46 in communication with flue gas input port 58 of thermal addition heat exchanger 56.

Thermal fluid passing through thermal extraction heat exchanger 46 is in a closed loop connection with thermal fluid passing through thermal addition heat exchanger 56. More specifically, thermal fluid input port 52 of thermal extraction heat exchanger 46 is in communication with thermal fluid output port 64 of thermal addition heat exchanger 56 through line 63*a* and thermal fluid output port 54 of thermal extraction heat exchanger 46 is in communication with thermal fluid input port 62 of thermal addition heat exchanger 56 through line 63*b*. Thermal fluid is circulated through the closed loop of thermal extraction heat exchanger 46 and thermal addition heat exchanger 56 via a pump 63*c* to convey heat from flue gas flowing through thermal extraction heat exchanger 46 to flue gas flowing through thermal addition heat exchanger 56. Such heat transfer causes the temperature of flue gas flowing from the flue gas output port 60 of thermal addition heat exchanger 56 to gas input port 44 of gas expander 42 to be higher than the temperature of flue gas flowing from the flue gas output port 50 of thermal extraction heat exchanger 46. For example, in an embodiment the temperature of flue gas at flue gas input port 58 of thermal addition heat exchanger 56 can be 230-212° F. at 120-230 psi whereas the temperature of flue gas at flue gas output port 60 of thermal addition heat exchanger 56 can be 900-650° F. at 115-225 psi.

Thermal fluid that circulates in the closed loop between heat exchangers 46 and 56 must be of a type that is stabile (i.e. does not change between liquid and gas states) at high temperatures. Syltherm™ is an example of such a thermal fluid.

Increasing the temperature of flue gas flowing from thermal addition heat exchanger 56 to gas expander 42 greatly improves the efficiency of gas expander 42. In addition, this avoids icing conditions in gas expander 42 and acid condensation conditions in discharge stack. Generally, temperatures above 250° F. in the stack are preferred to avoid acid condensation.

As also shown in the disclosed interface of FIG. 1, flue gas output port 50 of thermal extraction heat exchanger 46 and flue gas input port 58 of thermal addition heat exchanger 56 are selectively in communication through several states of connection. In a first state, they are in communication, respectively, with the input 101 and gas output 103 of CO2 capture unit 18. In a second state, they are in communication with opposite ends of a bypass conduit 68 that bypasses CO2 Capture Unit 18. The second state is useful to enable the power generation facility to continue to operate during periods when CO2 Capture Unit 18 is being serviced or during start-up periods before suitable operating temperatures and system efficiencies are established. At times when flue gas output port 50 of thermal extraction heat exchanger 46 and flue gas input 58 of thermal addition heat exchanger 56 are connected in the second state to opposite ends of bypass conduit 68, heat transfer between thermal extraction heat exchanger 46 and thermal addition heat exchanger 56 is unnecessary. During such periods, circulation of thermal fluid between thermal extraction heat exchanger 46 and thermal addition heat exchanger 56 through lines 63*a* and 63*b* is blocked by, for example, valve 70 that is located in line 63*b* between thermal fluid output port 54 and thermal fluid input port 62 and valve 72 that is located in line 63*a* between thermal fluid input port 52 and thermal fluid output port 64. By closing valves 70 and 72, the flow of thermal fluid through the closed circuit is prevented so that heat of the gas flowing through thermal extraction heat exchanger 46 is not transferred to flue gas flowing through thermal addition heat exchanger 56. In this way, the temperature conditions of flue gas at gas expander 42 at times when the interface is connected in the first state with CO2 Capture Unit 18 is essentially the same as temperature conditions of flue gas at gas expander 42 at times when the interface is connected in the second state to bypass conduit 68 and flue gas bypasses CO2 Capture Unit 18.

FIG. 1 also shows an alternative embodiment in dashed lines wherein the temperature conditions of flue gas at gas expander 42 are maintained substantially constant independently of whether the interface is connected in the first state with flue gas flowing through CO2 Capture Unit 18 or the second state with flue gas flowing through bypass conduit 68 and not through CO2 Capture Unit 18. In this alternative embodiment, at times when flue gas does not flow through CO2 Capture Unit 18, flue gas from HRSG 20 bypasses thermal extraction heat exchanger 46 through line 78 and bypasses thermal addition heat exchanger 56 through line 79. In this way, the interface maintains substantially consistent flue gas temperature conditions at gas expander 42 when CO2 Capture Unit 18 is actively connected with the interface in the first state and when CO2 Capture Unit 18 is connected in the second state and is bypassed.

FIG. 1 further shows a metal media filter 80 that is in communication with the flue gas output port 50 of thermal extraction heat exchanger 46. Thermal extraction heat exchanger 46 lowers the temperature of flue gas typically from about 900-650° F. at 145-255 psi at flue gas input port 48 to about 900-350° F. at 140-250 psi at the downstream side of metal media filter 80. The lower temperature of flue gas at output port 50 facilitates the use of metal media filters in the flue gas pathway so that particulates can be removed from the flue gas stream making downstream processing of the flue gas much cleaner. Metal media filters are advantageous in that they are relatively low cost in comparison to filters such as fabric filters that are used for particulate removal at higher flue gas temperatures. A further advantage of lower flue gas temperatures at the flue gas output port 50 of thermal extraction heat exchanger 46 includes a less-costly expander 42 that is designed for lower temperatures. Also, removal of particulates by metal media filter 80 reduces the erosion of rotor blades in gas expander 42 caused by particulate impact.

CO2 Capture Unit 18 requires maximum permissible limits of particulates, sulfur dioxide and nitrous oxides. FIG. 1 also shows a sulfur dioxide removal unit 82 that is in communication with the output of metal media filter 80 and downstream from the metal media filter. Sulfur dioxide removal unit 82 can, for example, be implemented as the injection of an SO2 capture agent using wet scrubber, dry or spray drying absorption technology such as is known to those skilled in the art. Flue gas temperatures at the downstream side of sulfur dioxide removal unit 82 can be in the range of 350-212° F. at 130-240 psi.

In addition, the disclosed system can include a nitrous oxide treatment unit 84 such as a selective catalytic reduction unit. In the preferred embodiment, this can be located in the flue gas stream downstream from the discharge conduit 13 of PFBCU 12. Treatment of the flue gas by metal media filter 80, sulfur dioxide removal unit 82, and nitrous oxide treatment unit 84 conditions the flue gas to meet preferred operating conditions for treatment by CO2 Capture Unit 18.

Additionally, FIG. 1 illustrates that a plurality of heat exchangers such as heat exchangers 85*a*, 85*b*, 85*c* and 85*d* can be used to control the temperature of flue gas in various locations of the disclosed system for purposes of preheating feed water to PFBCU 12 and to HRSG 20. Preheating the feed water in this way increases the efficiency of power generating facility 10. In the example of the embodiment of FIG. 1, heat exchangers 85*a* and 85*b* have respective gas sides that are open to the flow of flue gas and liquid sides that transfer heat to heat exchangers 85*c* and 85*d*. Heat exchangers 85*c* and 85*d* have respective water sides with input and output ports such that heat exchanger 85*c* preheats feed water to PFBCU 12 and heat exchanger 85*d* preheats feed water to HRSG 20.

Figure 2:
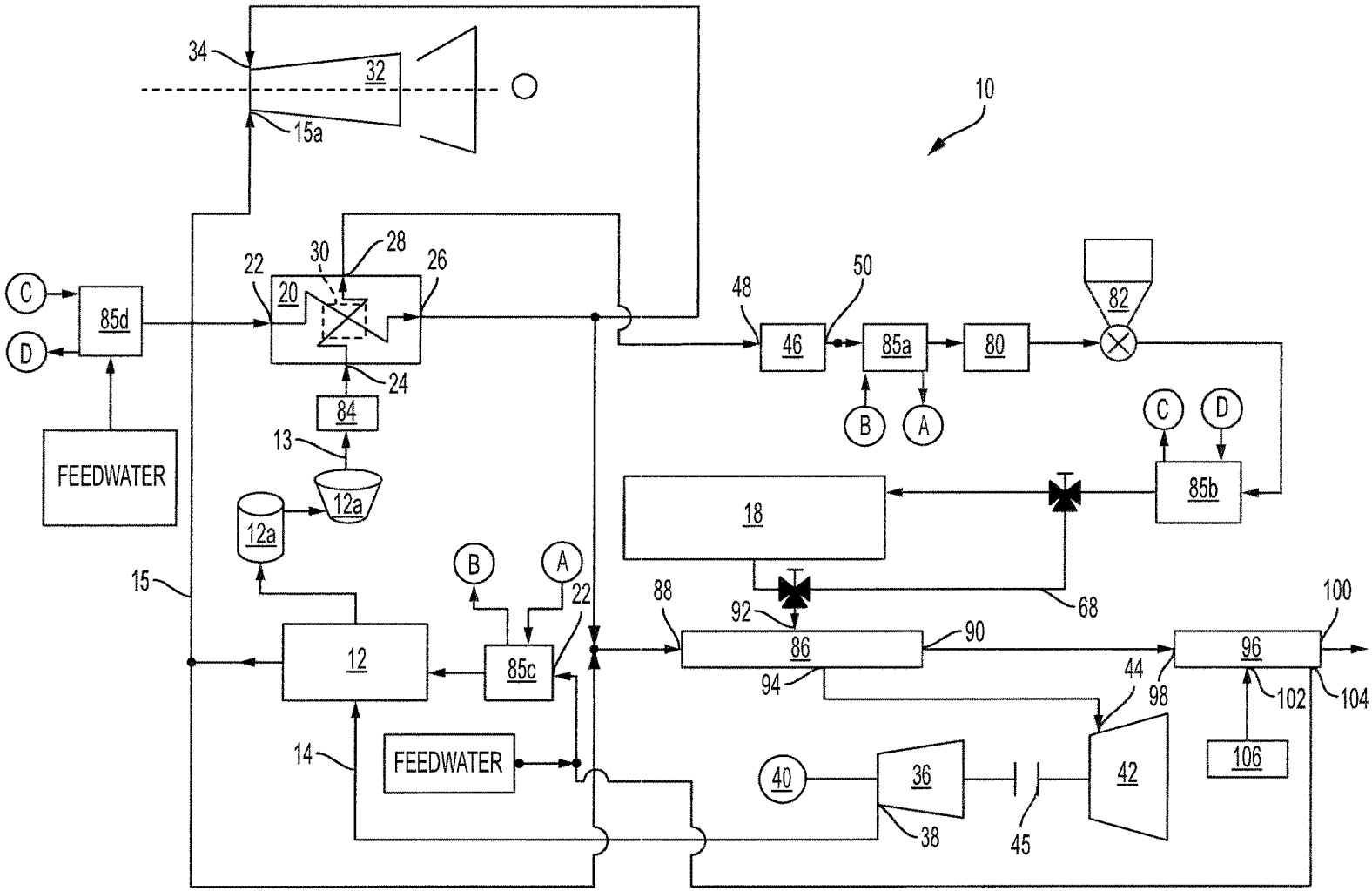
FIG. 2 is a schematic diagram of a power generation facility that includes an alternative improved interface for a unit for removing carbon dioxide. The interface has a heat recovery steam generator that lowers the temperature of flue gas from the pressurized fluidized bed combustion unit to a temperature that is compatible with the carbon dioxide removal unit. The heat recovery steam generator also provides steam to a heat exchanger that increases the temperature of flue gas flowing to a gas expander.

FIG. 2 is a schematic diagram of a power generation facility with an alternative embodiment of an interface that is in accordance with the presently disclosed invention. Elements and features of the system shown in FIG. 2 that are equivalent to those shown and described in connection with FIG. 1 are identified by like reference characters. Similar to the system of FIG. 1, in the system of FIG. 2 a PFBCU 12 receives air from an air feed 14 to a coal bed that is maintained in PFBCU 12. An interface for adapting the power generation facility for compatibility with CO2 Capture Unit 18 to treat exhaust gases from PFBCU 12 includes HRSG 20 that generates steam at steam output port 26 and flue gases at exhaust gas output port 28 in response to feed water provided to water intake port 22 in combination with exhaust gases from PFBCU 12 provided to exhaust gas input port 24. Steam input port 34 of steam turbine generator 32 is connected to steam output port 26 of HRSG 20 so that steam turbine generator 32 generates electrical power in response to steam supplied to steam input port 34.

Air compressor 36 has a first drive in which electrical motor 40 that is electrically connected to the electrical power output of steam turbine generator 32 and is mechanically coupled to air compressor 36. Air compressor 36 also has, as a second drive, gas expander 42 that has a gas input port 44. Gas expander 42 is responsive to the flow of flue gases into gas input port 44 and is selectively mechanically coupled to air compressor 36.

In the embodiment of FIG. 2, a heat exchanger 86 has a thermal fluid input port 88, a thermal fluid exhaust port 90, a flue gas input port 92, and a flue gas output port 94. Thermal fluid input port 88 is in communication with thermal fluid exhaust port 90 through a first pathway that is internal to heat exchanger 86. Flue gas input port 92 is in communication with flue gas output port 94 through a second pathway that is internal to heat exchanger 86. Flue gas output port 94 of heat exchanger 86 is also in communication with gas input port 44 of gas expander 42 and thermal fluid input port 88 of heat exchanger 86 is also in communication with steam from PFBCU 12 or steam output port 26 of HRSG 20 or both. Heat exchanger 86 provides heated flue gas at flue gas output port 94 in response to steam flow into thermal fluid input port 88 in combination with flue gas flow into flue gas input port 92. The temperature of flue gas at gas input port 44 of gas expander 42 is higher than the temperature of flue gas entering the flue gas input port 92 of heat exchanger 86.

In the interface shown in FIG. 2, flue gas output port 28 of HRSG 20 and flue gas input port 92 of heat exchanger 86 are in communication with CO2 Capture Unit 18 with flue gas output port 28 being upstream of CO2 Capture Unit 18 and flue gas input port 92 being downstream of CO2 Capture Unit. In the embodiment of FIG. 2, the transfer of heat through the heat transfer member 30 of HRSG 20 is adjusted so that the temperature of flue gas from exhaust gas output port 28 is consistent with the preferred operating temperature of flue gas for CO2 Capture Unit 18 to remove carbon dioxide from flue gas.

In the interface of FIG. 2, exhaust gas output port 28 of HRSG 20 and flue gas input port 92 of heat exchanger 86 are selectively connected in a first state to being them in communication with CO2 Capture Unit 18 or, alternatively, in a second state to being them in communication with bypass conduit 68 while avoiding CO2 Capture Unit 18. Heat transfer through heat transfer member 30 of HRSG 20 is such that the temperature of flue gas from exhaust gas output port 28 of HRSG 20 is compatible with the preferred operating temperature of flue gas for CO2 Capture Unit 18 at times when exhaust gas output port 28 and flue gas output port 94 from heat exchanger 86 are connected in the first state in which they are in communication with CO2 Capture Unit 18 and also at times when exhaust gas output port 28 and flue gas output 94 of heat exchanger 86 are connected in the second state in which they communicate with bypass conduit 68.

The interface shown in FIG. 2 also can include a sulfur dioxide removal unit 82. Sulfur dioxide removal unit 82 is in communication with and downstream of exhaust gas output port 28 of HRSG 20 and also in communication with and upstream of flue gas input port 92 of heat exchanger 86. The interface can also include nitrous oxide treatment unit 84 that is in communication with and upstream of exhaust gas input port 24 of HRSG 20 and also in communication with and downstream of exhaust gas from PFBCU 12.

Also in the interface of FIG. 2, a filter for removing particulates from flue gas such as metal media filter 80 is in communication with and downstream of exhaust gas output port 28 of HRSG 20 and also in communication with and upstream of flue gas input port 92 of heat exchanger 86. Because HRSG 20 lowers the temperature of the flue gas to a temperature that is compatible with the process temperature suitable for CO2 Capture Unit 18, the less-costly metal media filter can be used.

The interface of FIG. 2 also can include at least one additional heat exchanger 96 with a steam input port 98, a thermal fluid exhaust port 100, a feed water input port 102, and a feed water output port 104. Feed water input port 102 is connected to a feed water source 106. Feed water output port 104 of heat exchanger 96 is in communication with and upstream of water intake port 22 of heat exchanger 85*c* and steam input port 98 is in communication with and downstream of heat exchanger 86. In this way, heat exchanger 96 recovers heat from steam that is exhausted from heat exchanger 86 and uses the recovered heat to preheat the feed water to PFBCU 12.

While several preferred embodiments of the presently disclosed invention are shown and described herein, the disclosed invention is not limited thereto and can be variously embodied within the scope of the following claims.

I claim:

1. For use in a power generation facility that includes a pressurized fluidized bed combustion unit wherein air is supplied through an air feed to a fuel bed and a steam turbine generator having a steam input port that is connected to the steam output port of the fluidized bed combustion unit and that generates electrical power in response to steam supplied to said steam input port;

an interface for adapting the power generation facility for compatibility with a carbon dioxide capture unit that removes carbon dioxide from exhaust gases from said pressurized fluidized bed combustion unit, said interface including:

a heat recovery steam generator that has a water intake port for receiving water, an exhaust gas input port for receiving exhaust gases from said pressurized fluidized bed combustion unit, a steam output port that communicates with said water intake port and that is connected to the steam input port of the steam turbine generator, an exhaust gas output port that communicates with said exhaust gas input port, and a heat transfer member that isolates said water intake port and said steam output port from said exhaust gas input port and said exhaust gas output port, said heat recovery steam generator generating steam to the steam turbine generator at said steam output port and exhaust gases at said exhaust gas output port in response to water provided to said water intake port in combination with exhaust gasses from said pressurized fluidized bed combustion unit to said exhaust gas input port;

an air compressor having an output port that is connected to the air feed of the pressurized fluidized bed combustion unit, said air compressor having a first drive that is an electrical motor that is electrically connected to said steam turbine generator and that is mechanically coupled to said air compressor, said air compressor also having a second drive that is a gas expander having a gas input port, said gas expander being responsive to the flow of gases into said gas input port and being selectively mechanically coupled to said air compressor;

a first thermal extraction heat exchanger having a flue gas input port and a flue gas output port that is in communication with the flue gas input port, said thermal extraction heat exchanger also having a thermal fluid input port and a thermal fluid output port in communication with the first thermal fluid input port; and a thermal addition heat exchanger having a flue gas input port and a flue gas output port that is in communication with the flue gas input port, said thermal addition heat exchanger also having a thermal fluid input port and a thermal fluid output port that is in communication with the thermal fluid input port, the flue gas input port of said thermal extraction heat exchanger being in communication with the flue gas output of said heat recovery steam generator, the flue gas output port of said thermal extraction heat exchanger being in communication with the flue gas input port of said thermal addition heat exchanger, the thermal fluid input port of said thermal extraction heat exchanger being in communication with the thermal fluid output port of said thermal addition heat exchanger, and the thermal fluid output port of said thermal extraction heat exchanger being in communication with the thermal fluid input port of said thermal addition heat exchanger to provide a closed pathway wherein thermal fluid is circulated through said thermal extraction heat exchanger and through said thermal addition heat exchanger to convey heat from flue gas passing through the thermal extraction heat exchanger to flue gas passing through the thermal addition heat exchanger such that temperature of flue gas flowing from the flue gas output port of said thermal addition heat exchanger to said input port of said gas expander is higher than the temperature of flue gas flowing from the flue gas output port of said thermal extraction heat exchanger.

2. The interface of claim 1 wherein the flue gas output of said thermal extraction heat exchanger and the flue gas input of said thermal addition heat exchanger are selectively connectable in a first state to said carbon dioxide capture unit and in a second state to a bypass conduit that avoids said carbon dioxide capture unit, at times when the flue gas output of said thermal extraction heat exchanger and the flue gas input of said thermal addition heat exchanger are connected in the second state to the bypass conduit, there is no circulation of thermal fluid through said thermal extraction heat exchanger and said thermal addition heat exchanger so as to maintain consistent conditions of the gas expander when the carbon dioxide capture unit is active and when the carbon dioxide capture unit is bypassed.

3. The interface of claim 2 wherein the flue gas output of said thermal extraction heat exchanger and the flue gas input of said thermal addition heat exchanger are selectively connectable in a first state to said carbon dioxide capture unit and in a second state to a bypass conduit that avoids said carbon dioxide capture unit, at times when the flue gas output of said thermal extraction heat exchanger and the flue gas input of said thermal addition heat exchanger are connected in the second state to the bypass conduit, flue gas bypasses the thermal extraction heat exchanger and the thermal addition heat exchanger so as to maintain consistent conditions of the gas expander when the carbon dioxide capture unit is active and when carbon dioxide capture unit is bypassed.

4. The interface of claim 1 wherein, at times when carbon dioxide capture unit removes carbon dioxide form the exhaust gas, the thermal fluid is in a closed loop.

5. The interface of claim 1 wherein a metal media filter is included in the pathway of flue gas between the output of the thermal extraction heat exchanger and the input of the thermal addition heat exchanger.

6. The interface of claim 5 wherein said system includes a sulfur dioxide capture unit that is located between the flue gas output of said thermal extraction heat exchanger and the flue gas input of said thermal addition heat exchanger.

7. The interface of claim 1 wherein said heat exchanger further conveys heat to feed water.

8. The interface of claim 1 wherein sulfur dioxide and particulates are removed from the exhaust gas.

9. For use in a power generation facility that includes a pressurized fluidized bed combustion unit wherein air is supplied through an air feed to a fuel bed and wherein a steam turbine generator having a steam input port that is connected to the steam output port of the fluidized bed combustion unit and that generates electrical power in response to steam supplied to said steam input port;

an interface for adapting the power generation facility for compatibility with a carbon dioxide capture unit that removes carbon dioxide from exhaust gases from said pressurized fluidized bed combustion unit, said interface including:

a heat recovery steam generator that has a water intake port for receiving water, an exhaust gas input port for receiving exhaust gases from said pressurized fluidized bed combustion unit, a steam output port that communicates with said water intake port and that is connected to the steam input port of the steam turbine generator, an exhaust gas output port that communicates with said exhaust gas input port, and a heat transfer member that isolates said water intake port and said steam output port from said exhaust gas input port and said exhaust gas output port, said heat recovery steam generator generating steam to the steam turbine generator at said steam output port and flue gases at said exhaust gas output port in response to water provided to said water intake port in combination with exhaust gases from said pressurized fluidized bed combustion unit provided to said exhaust gas input port;

an air compressor having an output port that is connected to the air feed of the pressurized fluidized bed combustion unit, said air compressor having a first drive that is an electrical motor that is electrically connected to said steam turbine generator and that is mechanically coupled to said air compressor, said air compressor also having a second drive that is a gas expander having a gas input port, said gas expander being responsive to the flow of flue gases into said gas input port and being selectively mechanically coupled to said air compressor; and a heat exchanger having a thermal fluid input port, a thermal fluid exhaust port, a flue gas input port, and a flue gas output port, said thermal fluid input port being in communication with said thermal fluid exhaust port and said flue gas input port being in communication with said flue gas output port, said flue gas output port of said heat exchanger also being in communication with the gas input port of said gas expander and said thermal fluid input port of said heat exchanger also being in communication with the steam output port of said heat recovery steam generator, said heat exchanger providing heated flue gas at said flue gas output port in response to steam flow into said thermal fluid input port in combination with flue gas flow into said flue gas input port such that the temperature of flue gas at the gas input port of said gas expander is higher than the temperature of flue gas entering the flue gas input port of said heat exchanger.

10. The interface of claim 9 wherein the flue gas output of said heat recovery steam generator and the flue gas input port of said heat exchanger are connected to said carbon dioxide capture unit, and wherein the transfer of heat through the heat transfer member of said heat recovery steam generator is established such that the temperature of flue gas from the exhaust gas output port of said heat recovery steam generator is compatible with the temperature of flue gas for said carbon dioxide capture unit.

11. The interface of claim 10 wherein the flue gas output of said heat recovery steam generator and the flue gas input port of said heat exchanger are connected in a first state to said carbon dioxide capture unit and in a second state to a bypass conduit that avoids said carbon dioxide capture unit, and wherein the transfer of heat through the heat transfer member of said heat recovery steam generator is established such that the temperature of flue gas from the exhaust gas output port of said heat recovery steam generator is compatible with the temperature of flue gas for said carbon dioxide capture unit at times when the flue gas output of said thermal extraction heat exchanger and the flue gas input of said thermal addition heat exchanger are connected in said first state and at times when the flue gas output of said thermal extraction heat exchanger and the flue gas input of said thermal addition heat exchanger are connected in said second state.

12. The interface of claim 9 further comprising a unit for removing sulfur dioxide from flue gas, said unit for removing sulfur dioxide from flue gas being in communication with and downstream of the exhaust gas output port of the heat recovery steam generator and also being in communication with and upstream of the flue gas input port of the heat exchanger.

13. The interface of claim 9 further comprising a unit for removing nitrous oxides from flue gas, said unit for removing nitrous oxides from flue gas being in communication with and downstream of the exhaust gas output port of the heat recovery steam generator and also being in communication with and upstream of the flue gas input port of the heat exchanger.

14. The interface of claim 10 further comprising a unit for removing particulates from flue gas, said unit for removing particulates from flue gas being in communication with and downstream of the exhaust gas output port of the heat recovery steam generator and also being in communication with and upstream of the flue gas input port of the heat exchanger.

15. The interface of claim 14 wherein said unit for removing particulates from flue gas comprises a metal media filter.

16. The interface of claim 9 further comprising at least one additional heat exchanger with steam input port, a thermal fluid exhaust port, a feed water input port, and a feed water output port, with the feed water output port of said additional heat exchanger being in communication with and upstream of the water intake port of said heat recovery steam generator and said steam input port being in communication with and downstream of the steam output port of said heat recovery steam generator.

* * * * *